US012661756B2

(12) United States Patent
Saito

(10) Patent No.: US 12,661,756 B2
(45) Date of Patent: Jun. 23, 2026

(54) METHOD OF GRINDING WORKPIECE INCLUDING TWO GRINDING STEPS

(71) Applicant: DISCO CORPORATION, Tokyo (JP)

(72) Inventor: Makoto Saito, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 256 days.

(21) Appl. No.: 18/061,058

(22) Filed: Dec. 2, 2022

(65) Prior Publication Data

US 2023/0173638 A1 Jun. 8, 2023

(30) Foreign Application Priority Data

Dec. 3, 2021 (JP) ..... 2021-196803

(51) Int. Cl.
*B24B 49/02* (2006.01)
*B24B 7/04* (2006.01)
*B24B 7/22* (2006.01)

(52) U.S. Cl.
CPC ..... *B24B 49/02* (2013.01); *B24B 7/228* (2013.01); *B24B 7/04* (2013.01)

(58) Field of Classification Search
CPC .. B24B 7/22; B24B 7/228; B24B 7/00; B24B 7/04; B24B 41/00; B24B 41/06; B24B 49/00; B24B 49/02; B24B 49/04; H01L 21/304
See application file for complete search history.

(56) References Cited

U.S. PATENT DOCUMENTS 6,406,357 B1 6/2002 Kazui et al.
2015/0239089 A1 8/2015 Hirayama et al.

FOREIGN PATENT DOCUMENTS

CN 102945826 A * 2/2013
JP 01115559 A 5/1989
JP 2000260738 A 9/2000
JP 2001345291 A * 12/2001
JP 2003181759 A * 7/2003
JP 2008310897 A * 12/2008
JP 2009090389 A 4/2009
(Continued)

OTHER PUBLICATIONS

Office Action issued in counterpart Japanese patent application No. 2021-196803, dated Aug. 5, 2025.
(Continued)

*Primary Examiner* — Carlos A Rivera
(74) *Attorney, Agent, or Firm* — GREER BURNS & CRAIN, LTD.

(57) ABSTRACT

A workpiece to be ground by a grinding wheel of a grinding apparatus has a first layer including a first material and a second layer including a second material that is harder to grind than the first material and stacked on the first layer. The rotational speed of the grinding wheel for grinding the second layer, i.e., a second rotational speed, is lower than the rotational speed of the grinding wheel for grinding the first layer, i.e., a first rotational speed. The second layer can thus be ground effectively, as it is not necessary to use a grinding wheel with a high grinding capability or to lower a rate at which the workpiece is ground. Consequently, it is possible to maintain productivity for device chips manufactured by dividing the workpiece, and also prevent the footprint of the grinding apparatus from increasing.

20 Claims, 6 Drawing Sheets

(56) References Cited

FOREIGN PATENT DOCUMENTS

| | | | | |
|---|---|---|---|---|
| JP | 2011222608 | A | * | 11/2011 |
| JP | 2012222123 | A | * | 11/2012 |
| JP | 2016097476 | A | * | 5/2016 |
| KR | 10-2004-0064209 | | * | 7/2004 |

OTHER PUBLICATIONS

Office Action issued in counterpart Korean Patent Application No. 10-2022-0164199, dated Mar. 15, 2026.

* cited by examiner

METHOD OF GRINDING WORKPIECE INCLUDING TWO GRINDING STEPS

BACKGROUND OF THE INVENTION

Field of the Invention

The present invention relates to a method of grinding a workpiece to a predetermined finishing thickness.

Description of the Related Art

Device chips including devices such as integrated circuits (ICs) or large-scale-integration (LSI) circuits are indispensable components in various electronic appliances such as mobile phones or personal computers. Such device chips are manufactured by forming a number of devices in respective demarcated areas on the face side of a workpiece such as a wafer and then dividing the areas including the individual devices therein from each other.

Workpieces from which to fabricate device chips are often ground before they are divided in order to thin down the device chips to be manufactured or expose metal electrodes included as components of the devices on the device chips. It has been customary to grind a workpiece by rotating a grinding wheel with an annular array of grindstones mounted thereon and bringing the grindstones into abrasive contact with the workpiece that is held on a chuck table (see, for example, JP 2009-90389A).

SUMMARY OF THE INVENTION

Workpieces to be ground include various materials. If a workpiece includes a wafer composed of silicon (Si), i.e., a silicon wafer, then a silicon oxide ($SiO_2$) film may be disposed on a surface of the silicon wafer. In some workpieces, metal electrodes included as components of devices to be incorporated on device chips are embedded in silicon wafers.

Difficulty in grinding materials varies with the kinds of materials to be ground. For example, when grindstones grind a workpiece of silicon oxide, abrasive grains contained in the grindstones tend to come off or drop out. Therefore, silicon oxide is harder to grind than silicon. Further, since a metal used as electrodes is less hard than silicon, grinding metal electrodes is likely to generate a large amount of minute grinding debris or swarf. As a result, the abrasive grains that are exposed on the lower surfaces of grindstones used to grind the metal electrodes are liable to be covered or loaded with the grinding swarf. Consequently, metal electrodes are harder to grind than silicon.

In view of the difficulties described above, workpieces are ground under different conditions depending on the kinds of materials to be ground. For example, for grinding a layer containing a hard-to-grind material, a grinding wheel with a high grinding capability, i.e., a grinding wheel having an annular array of grindstones that contain large abrasive grains, is used or a rate at which a workpiece is ground, i.e., a speed at which the grinding wheel and the chuck table are moved toward each other, is lowered.

However, if a grinding wheel with a high grinding capability is used to grind a layer containing a hard-to-grind material, then it is necessary to replace the existing grinding wheel with such a grinding wheel with a high grinding capability, or to use a grinding apparatus including two or more selectively actuatable grinding wheels that include a grinding wheel with a high grinding capability. This approach tends to lower the productivity for device chips or increase a footprint of the grinding apparatus. Similarly, lowering a rate at which a workpiece is ground for grinding a layer containing a hard-to-grind material is apt to result in a reduction in the productivity for device chips.

In view of the above problems, it is an object of the present invention to provide a method of grinding a workpiece while preventing the productivity for device chips from being lowered and also preventing the footprint of a grinding apparatus used from being increased.

In accordance with an aspect of the present invention, there is provided a method of grinding a workpiece to a predetermined finishing thickness, the workpiece having a first layer including a first material and a second layer including a second material that is harder to grind than the first material and stacked on the first layer. The method includes a first grinding step of grinding the first layer of the workpiece held on a chuck table with a plurality of grindstones included in a grinding wheel and arranged in an annular array while the grinding wheel is being rotated at a first rotational speed, and a second grinding step of grinding the second layer of the workpiece held on the chuck table with the plurality of grindstones while the grinding wheel is being rotated at a second rotational speed that is lower than the first rotational speed.

Preferably, the method further includes, between the first grinding step and the second grinding step, a spacing step of spacing the plurality of grindstones and the workpiece from each other.

Preferably, the first material is silicon, the second material is silicon oxide, and the first grinding step is carried out after the second grinding step is carried out to remove the second layer.

Preferably, when the second layer including silicon oxide, e.g., a silicon oxide film, is ground in the second grinding step, the second grinding step comes to an end upon elapse of a predetermined time after the second layer starts to be ground while the grinding wheel and the chuck table are moved relatively to each other at a predetermined speed to bring the grinding wheel and the chuck table closer to each other.

Alternatively, the second grinding step preferably comes to an end when a thickness of the workpiece that is being measured reaches a predetermined thickness.

According to the present invention, the rotational speed of the grinding wheel for grinding the second layer including the second material that is harder to grind than the first material is lower than the rotational speed of the grinding wheel for grinding the first layer including the first material.

So long as the rotational speed of the grinding wheel for grinding the workpiece is low, strong frictional forces act on each of the grindstones due to its abrasive contact with the workpiece, tending to scrape the grindstones. In other words, the action of self-sharpening of each of the grindstones is accelerated. The second layer can thus be ground without hitch.

As the second layer is ground in the manner described above, it is not necessary to use a grinding wheel with a high grinding capability or to lower a rate at which the workpiece is ground. Consequently, it is possible to prevent the productivity for device chips manufactured by dividing the workpiece from being lowered and also to prevent the footprint of the grinding apparatus from increasing.

The above and other objects, features and advantages of the present invention and the manner of realizing them will become more apparent, and the invention itself will best be understood from a study of the following description and appended claims with reference to the attached drawings showing some preferred embodiment of the invention.

DETAILED DESCRIPTION OF THE PREFERRED EMBODIMENT

Figure 1:
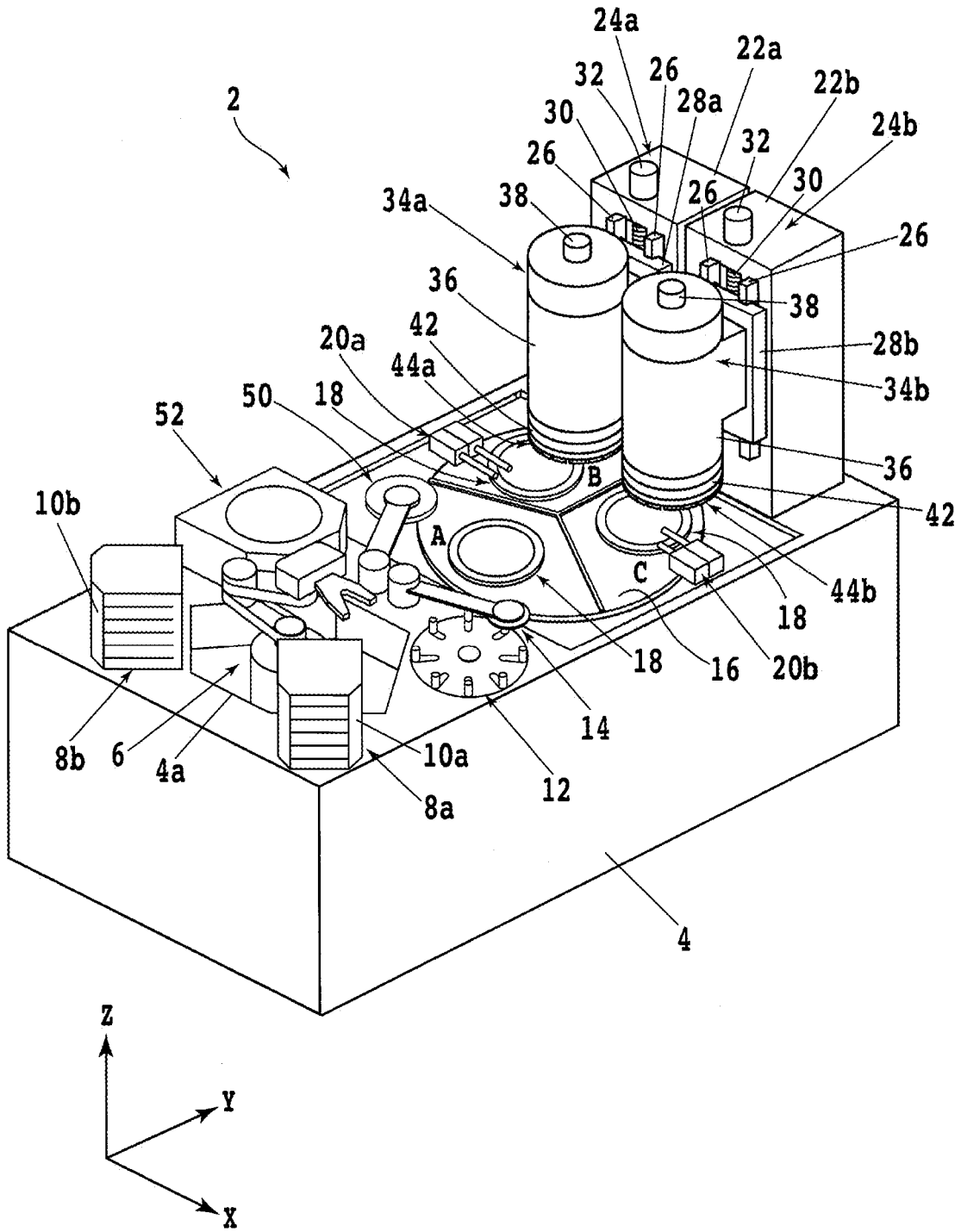
FIG. 1 is a perspective view schematically illustrating a grinding apparatus by way of example.

A preferred embodiment of the present invention will be described below with reference to the accompanying drawings. FIG. 1 schematically illustrates in perspective a grinding apparatus 2 according to the preferred embodiment. In FIG. 1, the grinding apparatus 2 is illustrated in reference to a three-dimensional coordinate system having X-, Y-, and Z-axes indicated respectively by the arrows X, Y, and Z. X-axis directions, i.e., leftward and rightward directions, that extend horizontally parallel to the X-axis, and Y-axis directions, i.e., forward and rearward directions, that extend horizontally parallel to the Y-axis are perpendicular to each other on a horizontal plane. Z-axis directions, i.e., upward and downward directions, that extend vertically parallel to the Z-axis are perpendicular to the X-axis directions and the Y-axis directions.

As illustrated in FIG. 1, the grinding apparatus 2 includes a base 4 supporting thereon and housing therein various components of the grinding apparatus 2. The base 4 has an opening 4*a* defined in an upper surface thereof at a front end portion of the base 4. The grinding apparatus 2 has a delivery unit 6 disposed in the opening 4*a*. The delivery unit 6 has a suction pad for attracting under suction a workpiece 11 to be described below, for example.

There are two cassette set-up areas 8*a* and 8*b* on the front end portion of the base 4 on respective left and right sides obliquely forward of the delivery unit 6. Two cassettes 10*a* and 10*b* each capable of storing a plurality of workpieces are disposed respectively in the cassette set-up areas 8*a* and 8*b*.

The cassette 10*a* stores therein a plurality of workpieces to be ground, i.e., a plurality of workpieces before they are ground, by the grinding apparatus 2, for example. The cassette 10*b* stores therein a plurality of ground workpieces, i.e., a plurality of workpieces after they have been ground, by the grinding apparatus 2, for example.

Figure 2A:
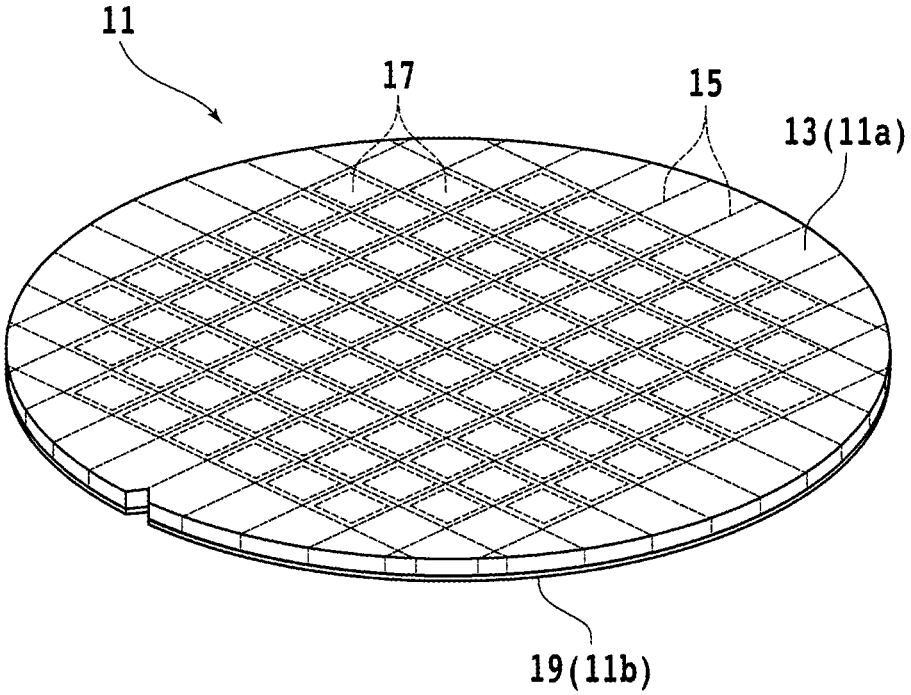
FIG. 2A is a perspective view schematically illustrating by way of example a workpiece before it is ground.
Figure 2B:
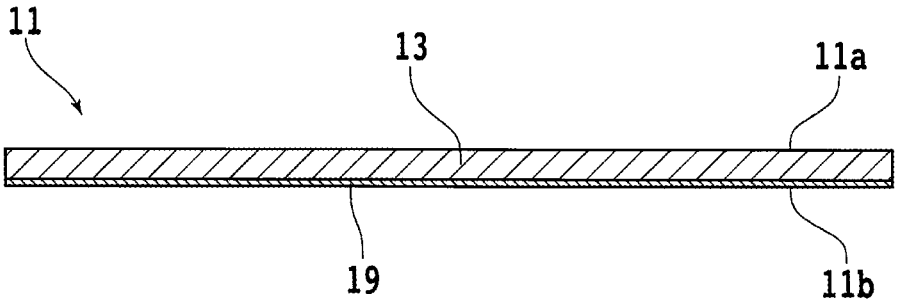
FIG. 2B is a cross-sectional view schematically illustrating by way of example the workpiece before it is ground.

FIG. 2A schematically illustrates in perspective a workpiece 11 before it is ground by way of example, and FIG. 2B schematically illustrates in cross section the workpiece 11 before it is ground by way of example. As illustrated in FIGS. 2A and 2B, the workpiece 11 includes a circular wafer, i.e., a first layer, 13 composed of silicon, i.e., a first material, on a face side 11*a* thereof.

The silicon wafer 13 has a plurality of areas demarcated by a grid of streets or projected dicing lines 15 established thereon. Devices 17 such ICs or LSI circuits are provided in the respective demarcated areas. A circular thin film, i.e., a second layer, 19 composed of silicon oxide, i.e., a second material, that is harder to grind than silicon is disposed on a reverse side 11*b* of the workpiece 11 in stacked relation to the silicon wafer 13.

The silicon oxide film 19 is deposited on the reverse side 11*b* in a process, e.g., a heating process, that is performed on the workpiece 11 at the time the devices 17 are constructed thereon. The workpiece 11 may include metal electrodes composed of a material that is harder to grind than silicon and provided as components of the devices 17 in the silicon wafer 13.

A film-like tape for protecting the devices 17 may be affixed to the face side 11*a* of the workpiece 11. The tape has a circular film-like base and an adhesive layer, i.e., a glue layer, disposed on the base, for example.

The base of the tape includes a resin such as polyolefin, polyvinyl chloride, or polyethylene terephthalate, for example. The adhesive layer of the tape includes an epoxy-based or acryl-based adhesive, for example. Alternatively, the adhesive layer may include an ultraviolet-curable resin that can be cured upon exposure to ultraviolet rays.

The workpiece 11 is not limited to any particular materials, shapes, structures, sizes, etc. For example, the workpiece 11 may include a wafer including any of other semiconductor materials or a substrate including a material such as ceramic, resin, or metal, for example. Similarly, the devices 17 are not limited to any particular types, numbers, shapes, structures, sizes, layouts, etc.

The cassette 10*a* illustrated in FIG. 1 stores therein a vertical array of workpieces 11 such that their reverse sides 11*b* with the silicon oxide films 19 disposed thereon face upwardly. The delivery unit 6 attracts the upper surface, i.e., the reverse side 11*b*, of one of the workpieces 11 in the cassette 10*a* under suction with the suction pad, and delivers the workpiece 11 held by the suction pad out of the cassette 10*a*.

The grinding apparatus 2 also includes a positioning mechanism 12 disposed on the base 4 at a position on a left side obliquely rearward of the delivery unit 6, to which the workpiece 11 taken out of the cassette 10*a* can be delivered by the delivery unit 6. When the workpiece 11 removed from the cassette 10*a* is delivered by the delivery unit 6 to the positioning mechanism 12, the positioning mechanism 12 operates to grip and place the workpiece 11 in a predetermined position.

Behind the delivery unit 6 and on the right side of the positioning mechanism 12, there is disposed a delivery unit 14 for delivering the workpiece 11 that has been positioned by the positioning mechanism 12 from the positioning mechanism 12. The delivery unit 14 has a suction pad for attracting under suction the upper surface, i.e., the reverse side 11*b*, of the workpiece 11, for example.

When the workpiece 11 positioned by the positioning mechanism 12 is attracted under suction by the suction pad of the delivery unit 14 and hence held by the delivery unit 14, the delivery unit 14 operates to turn the suction pad to deliver the workpiece 11 rearwardly.

A disk-shaped turntable 16 is disposed behind the delivery unit 14. The turntable 16 is coupled to a rotary actuator, not illustrated, such as an electric motor for rotating the turntable 16 about a rotational axis extending generally parallel to the Z-axis.

The turntable 16 supports thereon a plurality of chuck tables 18 each capable of holding under suction the lower surface, i.e., the face side 11*a*, of a workpiece 11. In FIG. 1, three chuck tables 18 are illustrated as being arrayed at generally equal spaced intervals circumferentially on the turntable 16.

Each of the chuck tables 18 has a circular upper surface lying generally parallel to a horizontal plane, i.e., an XY plane, lying along the X-axis and the Y-axis, and holds a workpiece 11 on the upper surface. The circular upper surface of each of the chuck tables 18 acts as a holding surface for holding the workpiece 11 thereon.

The turntable 16 is rotatable clockwise about the rotational axis as viewed in plan, for example, for positioning each of the chuck tables 18 successively in a delivery position A, a first grinding position, i.e., a roughly grinding position, B, a second grinding position, i.e., a finishing grinding position, C, and then back in the delivery position A. A workpiece 11 delivered from the positioning mechanism 12 by the delivery unit 14 is loaded onto the chuck table 18 positioned in the delivery position A.

The holding surface of each of the chuck tables 18 is fluidly connected to a suction source, not illustrated, such as an ejector through a fluid channel, not illustrated, defined in the chuck table 18, or a valve, not illustrated. When the suction source is actuated and the valve is opened while the workpiece 11 is being placed on the chuck table 18, the lower surface, i.e., the face side 11*a*, of the workpiece 11 is attracted under suction to the chuck table 18. The workpiece 11 is now held on the holding surface of the chuck table 18.

Each of the chuck tables 18 is coupled to a rotary actuator, not illustrated, such as an electric motor for rotating the chuck table 18 about a rotational axis extending generally parallel to the Z-axis. The rotary actuators coupled to the respective chuck tables 18 rotate the chuck tables 18 for grinding the workpieces 11 on the chuck tables 18 with a plurality of grindstones 48 (see FIG. 3) of each of two grinding wheels 44*a* and 44*b* to be described later.

Thickness measuring instruments 20*a* and 20*b* for measuring the thicknesses of the workpieces 11 on the chuck tables 18 are disposed respectively near the first grinding position B and the second grinding position C. The thickness measuring instruments 20*a* and 20*b* measure changes over time in the thicknesses of the workpieces 11 on the chuck tables 18 when the workpieces 11 are ground.

Specifically, each of the thickness measuring instruments 20*a* and 20*b* has a pair of height gages. One of the height gages has a measuring element for contacting the upper surface, i.e., the reverse side 11*b*, of the workpiece 11 that is exposed without being covered by one of the grinding wheels 44*a* and 44*b* when the workpiece 11 is ground. The other of the height gages has a measuring element for contacting the holding surface of the chuck table 18 that is exposed without being covered by the workpiece 11 and one of the grinding wheels 44*a* and 44*b* when the workpiece 11 is ground.

Therefore, when the workpiece 11 on each of the chuck tables 18 in the first grinding position B and the second grinding position C is ground, the height of the upper surface, i.e., the reverse side 11*b*, of the workpiece 11 and the height of the holding surface of the chuck table 18 are measured by the respective height gages. Each of the thickness measuring instruments 20*a* and 20*b* measures the difference between these measured heights as the thickness of the workpiece 11.

The grinding apparatus 2 further includes a columnar support structure 22*a* disposed on a rear end portion of the base 4 behind the first grinding position B and a columnar support structure 22*b* disposed on a rear end portion of the base 4 behind the second grinding position C. Moving mechanisms 24*a* and 24*b* for vertically moving, i.e., lifting and lowering, respective movable plates 28*a* and 28*b* along the Z-axis are mounted on respective front surfaces, i.e., face sides, of the support structures 22*a* and 22*b*.

Each of the moving mechanisms 24*a* and 24*b* has a pair of vertical guide rails 26 extending along the Z-axis and spaced apart from each other. The movable plates 28*a* and 28*b* are vertically slidably mounted on the guide rails 26 of the moving mechanisms 24*a* and 24*b*. A vertical screw shaft 30 extending along the Z-axis is disposed between the guide rails 26 of each of the moving mechanisms 24*a* and 24*b*.

An electric motor 32 for rotating the screw shaft 30 about its vertical axis is coupled to an upper end of the screw shaft 30. The screw shaft 30 has an externally threaded outer circumferential surface threaded through a nut, not illustrated, that contains a number of balls that circulate upon rotation of the screw shaft 30. The screw shaft 30, the nut, and the balls jointly include a ball screw.

The nut is fixed to a rear surface, i.e., a reverse side, of each of the movable plates 28*a* and 28*b*. When the electric motor 32 is energized, it rotates the screw shaft 30 about its vertical axis, causing the nut to move, i.e., lift and lower, each of the movable plates 28*a* and 28*b* along the Z-axis.

A grinding unit 34*a* for roughly grinding the workpiece 11 on the chuck table 18 in the roughly grinding position B is fixedly mounted on a front surface, i.e., a face side, of the movable plate 28*a*. On the other hand, a grinding unit 34*b* for finishing grinding the workpiece 11 on the chuck table 18 in the finishing grinding position C is fixedly mounted on a front surface, i.e., a face side, of the movable plate 28*b*.

When the movable plate 28*a* is lifted, the grinding unit 34*a* is also lifted. When the movable plate 28*b* is lifted, the grinding unit 34*b* is also lifted. Each of the grinding units 34*a* and 34*b* has a hollow cylindrical housing 36 whose longitudinal axis extends along the Z-axis.

The housing 36 supports on an upper end thereof an electric motor 38 that is coupled to a proximal end, i.e., an upper end, of a spindle 40 (see FIG. 3) rotatably housed in the housing 36. The spindle 40 extends along the Z-axis and has a distal end portion, i.e., a lower end portion, protruding downwardly from and exposed out of a lower end of the housing 36.

Figure 3:
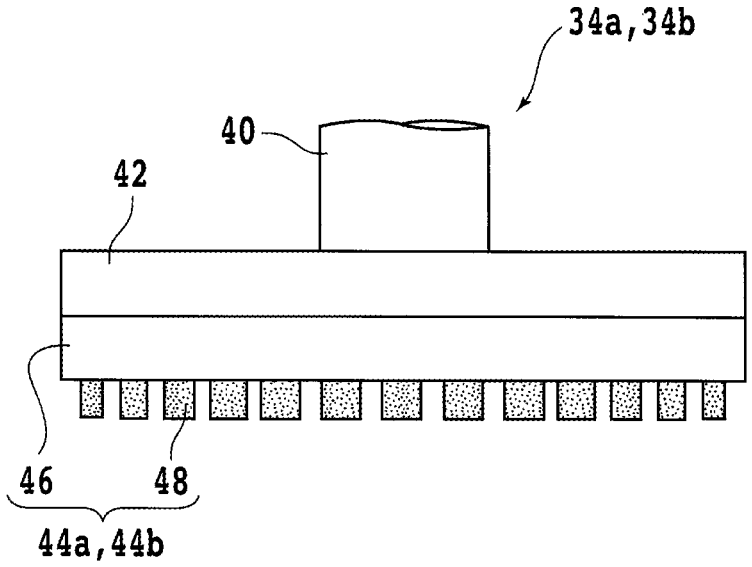
FIG. 3 is a side elevational view schematically illustrating some components of a grinding unit of the grinding apparatus.

FIG. 3 schematically illustrates in side elevation the components of each of the grinding units 34*a* and 34*b* that are exposed out of the housing 36. As illustrated in FIG. 3, the lower end portion of the spindle 40 that is exposed out of the housing 36 has a distal end to which a disk-shaped mount 42 composed of metal or the like is fixed.

The grinding wheel 44*a* for roughly grinding the workpiece 11 is mounted on a lower surface of the mount 42 of the grinding unit 34*a*, and the grinding wheel 44*b* for finishing grinding the workpiece 11 is mounted on a lower surface of the mount 42 of the grinding unit 34*b*. Each of the grinding wheels 44*a* and 44*b* is rotatable about a vertical axis generally parallel to the Z-axis by the power transmitted from the electric motor 38*a* through the spindle 40 and the mount 42.

Each of the grinding wheels 44*a* and 44*b* includes an annular wheel base 46 having an outside diameter that is generally equal to the diameter of the mount 42. The wheel base 46 is composed of a metal material such as aluminum or stainless steel, for example. Each of the grinding wheels 44*a* and 44*b* also includes the grindstones 48, mentioned earlier, fixed to a lower surface of the wheel base 46.

Each of the grindstones 48 is shaped as a rectangular parallelepiped, for example. The grindstones 48 are arranged in an annular array at generally equal spaced intervals circumferentially around the wheel base 46. Each of the grindstones 48 includes abrasive grains of diamond, cubic boron nitride (cBN), or the like that are bound together by a binder such as a metal bond, a resin bond, or a vitrified bond.

The grindstones 48 of the grinding wheel 44*a* include grindstones suitable for roughly grinding operation, whereas the grindstones 48 of the grinding wheel 44*b* include grindstones suitable for finishing grinding operation. Therefore, the abrasive grains of the grindstones 48 of the grinding wheel 44*b* have an average grain size that is smaller than the average grain of the abrasive grains of the grindstones 48 of the grinding wheel 44*a*, for example.

Each of the grinding units 34*a* and 34*b* has a grinding fluid supply passage, not illustrated, defined therein for supplying a grinding fluid such as pure water. Instead of or in addition to the grinding fluid supply passage, a nozzle for supplying a grinding fluid may be provided in the vicinity of each of the grinding units 34*a* and 34*b*.

When the workpieces 11 are ground by the grindstones 48 of the grinding wheels 44*a* and 44*b*, the grinding fluid is supplied to interfaces, i.e., processing points, where the workpieces 11 and the grindstones 48 are held in abrasive contact with each other. The supplied grinding fluid is effective to cool the workpieces 11 and the grindstones 48 and wash away debris or swarf generated from the workpieces 11 and the grindstones 48 when the workpieces 11 are ground by the grindstones 48.

The components of the grinding unit 34*a* and the chuck table 18 positioned in the first grinding position B are arranged such that the grindstones 48 of the grinding unit 34*a* follow a track across the center of the holding surface of the chuck table 18 when the grinding wheel 44*a* is rotated about its vertical axis.

Similarly, the components of the grinding unit 34*b* and the chuck table 18 positioned in the second grinding position C are arranged such that the grindstones 48 of the grinding unit 34*b* follow a track across the center of the holding surface of the chuck table 18 when the grinding wheel 44*b* is rotated about its vertical axis.

A delivery unit 50 for unloading a workpiece 11 from the chuck table 18 positioned in the delivery position A is disposed in a position adjacent to the delivery unit 14 along the X-axis. The delivery unit 50 has a suction pad for attracting under suction the upper surface, i.e., the reverse side 11*b*, of the workpiece 11, for example.

When the suction pad of the delivery unit 50 attracts a workpiece 11 under suction from the chuck table 18 in the delivery position A, the delivery unit 50 operates to turn the suction pad to move the workpiece 11 forwardly away from the chuck table 18.

The grinding apparatus 2 also includes a cleaning unit 52 disposed on the base 4 at a position on a right side obliquely forward of the delivery unit 50, to which the workpiece 11 taken from the chuck table 18 in the delivery position A can be delivered by the delivery unit 50. When the ground workpiece 11 removed from the chuck table 18 in the delivery position A is delivered by the delivery unit 50 to the cleaning unit 52, the cleaning unit 52 operates to clean the workpiece 11.

Figure 4:
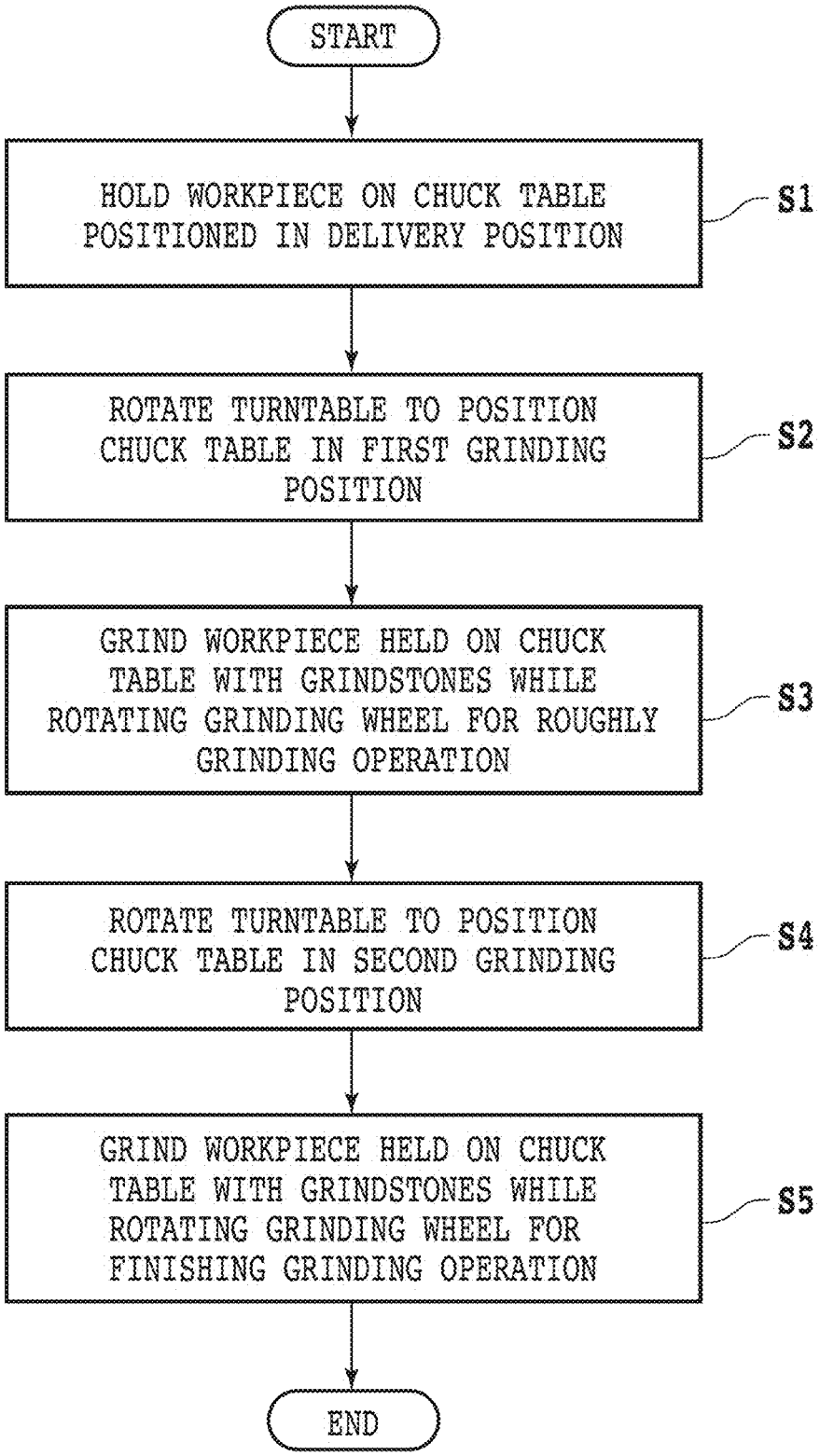
FIG. 4 is a flowchart schematically illustrating a sequence of a method of grinding a workpiece to thin down the workpiece to a predetermined finishing thickness according to a preferred embodiment of the present invention.

FIG. 4 is a flowchart schematically illustrating a sequence of a method of grinding a workpiece 11 on the grinding apparatus 2 to thin down the workpiece 11 to a predetermined finishing thickness according to the preferred embodiment of the present invention. According to the method, first, a workpiece 11 whose reverse side 11*b* faces upwardly is held on the chuck table 18 positioned in the delivery position A (holding step S1).

Then, the turntable 16 is rotated to position the chuck table 18 in the first grinding position B (first rotating step S2). Next, while the grinding wheel 44*a* for roughly grinding operation is being rotated about its vertical axis, the workpiece 11 held on the chuck table 18 is ground by the grindstones 48 of the grinding wheels 44*a* (roughly grinding step S3).

Figure 5:
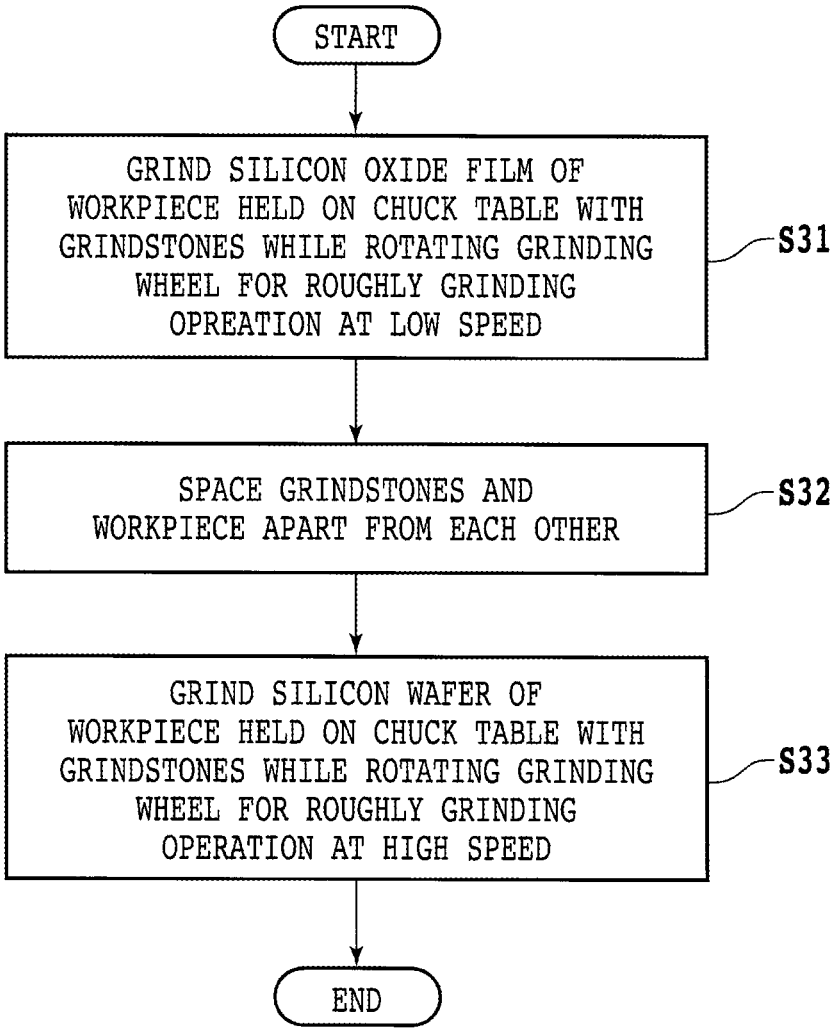
FIG. 5 is a flowchart schematically illustrating a sequence of a specific example of a roughly grinding step of the method.
Figure 6A:
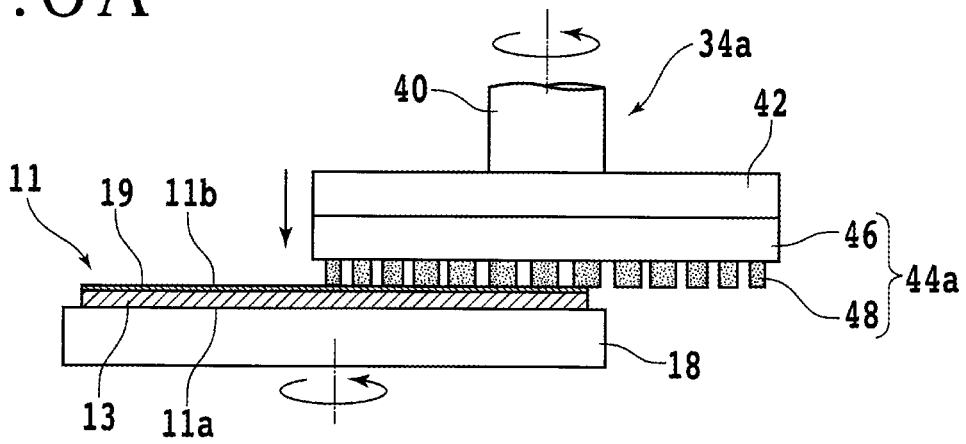
FIG. 6A is a side elevational view, partly in cross section, schematically illustrating the manner in which the roughly grinding step is carried out.
Figure 6B:
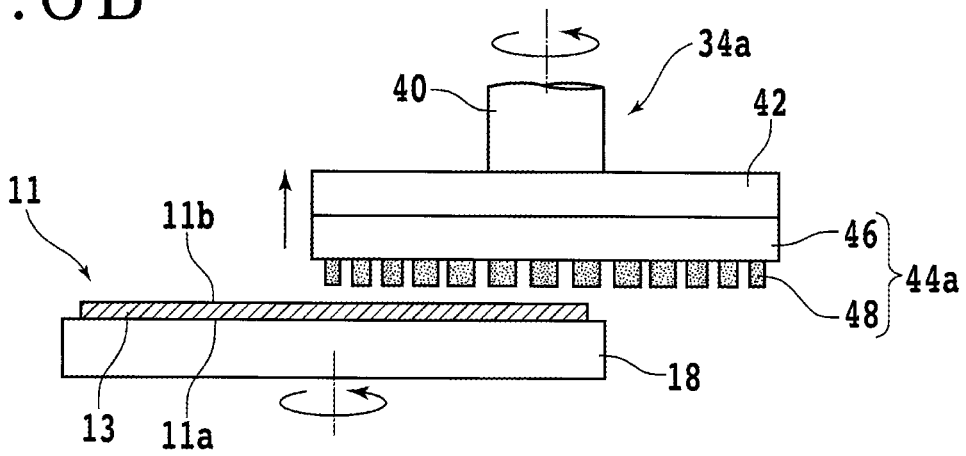
FIG. 6B is a side elevational view, partly in cross section, schematically illustrating the manner in which the roughly grinding step is carried out.
Figure 6C:
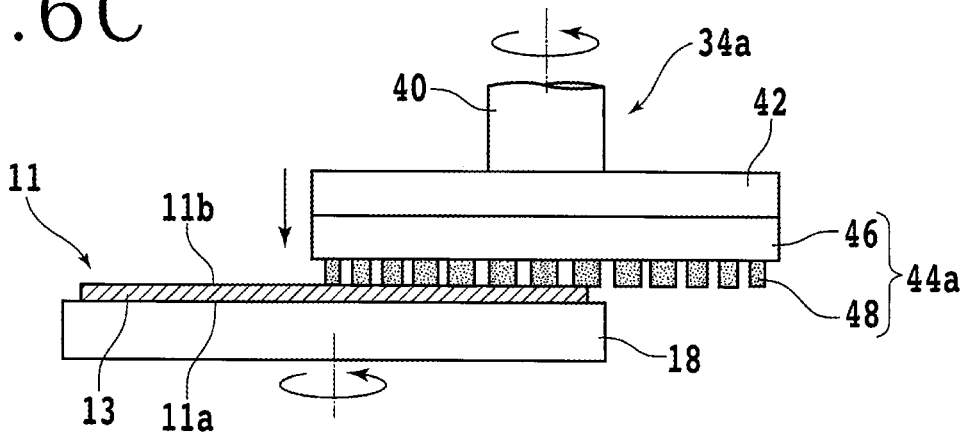
FIG. 6C is a side elevational view, partly in cross section, schematically illustrating the manner in which the roughly grinding step is carried out.

FIG. 5 is a flowchart schematically illustrating a sequence of a specific example of roughly grinding step S3. FIGS. 6A, 6B, and 6C schematically illustrate the manner in which roughly grinding step S3 is carried out.

In roughly grinding step S3, first, while the grinding wheel 44*a* for roughly grinding operation is being rotated about its vertical axis at a low speed, the silicon oxide film 19 of the workpiece 11 held on the chuck table 18 is ground by the grindstones 48 of the grinding wheel 44*a* (first grinding step S31).

Specifically, the electric motor 38 of the grinding unit 34*a* is energized to rotate the spindle 40 and the mount 42 and hence the grinding wheel 44*a* at a rotational speed, i.e., a second rotational speed, ranging from 700 rpm or more to less than 1500 rpm. In addition, the rotary actuator coupled to the chuck table 18 is energized to rotate the chuck table 18 at a rotational speed ranging from 100 or more to less than 300 rpm.

While both the grinding wheel 44*a* and the chuck table 18 are being rotated, the moving mechanism 24*a* lowers the movable plate 28*a* and the grinding unit 34*a* at a predetermined speed in order to bring the grinding wheel 44*a* and the chuck table 18 closer to each other.

The grindstones 48 are now brought into abrasive contact with the silicon oxide film 19 of the workpiece 11, grinding the silicon oxide film 19 (see FIG. 6A). First grinding step S31 is continued until the silicon oxide film 19 is removed.

For example, first grinding step S31 comes to an end upon elapse of a predetermined time after the silicon oxide film 19 started being ground, or specifically upon elapse of a time equal to or longer than a time calculated by dividing the thickness of the silicon oxide film 19 by the speed at which the grinding unit 34*a* is lowered.

Alternatively, first grinding step S31 may come to an end when the thickness of the workpiece 11 that is being measured by the thickness measuring instrument 20*a* has reached a predetermined thickness, or specifically, when the measured thickness of the workpiece 11 has reached a thickness equal to or smaller than a thickness calculated by subtracting the thickness of the silicon oxide film 19 from the original thickness of the workpiece 11.

Then, the grindstones 48 and the workpiece 11 are spaced apart from each other (spacing step S32). Specifically, while both the grinding wheel 44*a* and the chuck table 18 are being rotated, the moving mechanism 24*a* lifts the movable plate

28*a* and the grinding unit 34*a* in order to space the grindstones 48 and the workpiece 11 away from each other (see FIG. 6B).

Next, while the grinding wheel 44*a* for roughly grinding operation is being rotated at a high speed, the silicon wafer 13 of the workpiece 11 held on the chuck table 18 is ground by the grindstones 48 (second grinding step S33).

Specifically, the electric motor 38 is energized to rotate the spindle 40 and the mount 42 and hence the grinding wheel 44*a* at a rotational speed, i.e., a first rotational speed, ranging from 1500 rpm or more to more than 6000 rpm.

Then, while both the grinding wheel 44*a* and the chuck table 18 are being rotated, the moving mechanism 24*a* lowers the movable plate 28*a* and the grinding unit 34*a* at a predetermined speed, e.g., a speed equal to the speed at which the movable plate 28*a* and the grinding unit 34*a* were lowered in first grinding step S31, in order to bring the grinding wheel 44*a* and the chuck table 18 closer to each other.

The grindstones 48 are now brought into abrasive contact with the silicon wafer 13 of the workpiece 11, grinding the silicon wafer 13 (see FIG. 6C). Second grinding step S33 may come to an end upon elapse of a predetermined time after the silicon wafer 13 started being ground or when the thickness of the workpiece 11 has reached a predetermined thickness.

Then, the electric motor 38 and the rotary actuator coupled to the chuck table 18 are de-energized to stop rotating both the grinding wheel 44*a* and the chuck table 18. Moreover, the moving mechanism 24*a* lifts the movable plate 28*a* and the grinding unit 34*a* in order to space the grindstones 48 and the workpiece 11 away from each other.

Then, the turntable 16 is rotated to position the chuck table 18 in the second grinding position C (second rotating step S4). Next, while the grinding wheel 44*b* for finishing grinding operation is being rotated about its vertical axis, the workpiece 11 held on the chuck table 18 is ground by the grindstones 48 (finishing grinding step S5).

Specifically, the electric motor 38 is energized to rotate the spindle 40 and the mount 42 and hence the grinding wheel 44*b* at a predetermined rotational speed. In addition, the rotary actuator coupled to the chuck table 18 is energized to rotate the chuck table 18 at a predetermined rotational speed.

While both the grinding wheel 44*b* and the chuck table 18 are being rotated, the moving mechanism 24*b* lowers the movable plate 28*b* and the grinding unit 34*b* at a predetermined speed in order to bring the grinding wheel 44*b* and the chuck table 18 closer to each other.

The grindstones 48 are now brought into abrasive contact with the silicon wafer 13 of the workpiece 11, grinding the silicon wafer 13. Finishing grinding step S5 is continued until the thickness of the workpiece 11 that is being measured by the thickness measuring instrument 20*b* has reached a predetermined thickness. The method of grinding a workpiece illustrated in FIG. 4 is now completed.

In roughly grinding step S3 described above, the rotational speed of the grinding wheel 44*a* for grinding the thin film, i.e., the silicon oxide film, 19 composed of silicon oxide that is harder to grind than silicon is lower than the rotational speed of the grinding wheel 44*a* for grinding the wafer, i.e., the silicon wafer, 13 composed of silicon.

So long as the rotational speed of the grinding wheel 44*a* for grinding the workpiece 11 is low, strong frictional forces act on each of the grindstones 48 due to its abrasive contact with the workpiece 11, tending to scrape the grindstones 48. In other words, the action of self-sharpening of each of the grindstones 48 is accelerated. The silicon oxide film 19 can thus be ground without hitch.

As the silicon oxide film 19 is ground in the manner described above, it is not necessary to use a grinding wheel with a high grinding capability or to lower a rate at which the workpiece 11 is ground, i.e., the speed at which the grinding wheel 44*a* is lowered. Consequently, it is possible to prevent the productivity for device chips manufactured by dividing the workpiece 11 from being lowered and also to prevent a footprint of the grinding apparatus 2 from increasing.

The method of grinding a workpiece as described above is in accordance with an aspect of the present invention, and the present invention is not limited to the above method of grinding a workpiece. The method of grinding a workpiece according to the present invention may be carried out in order to expose metal electrodes composed of a material that is harder to grind than silicon and provided as components of the devices 17, on the reverse side 11*b* of the workpiece 11.

In such an application, first, the reverse side 11*b* of the workpiece 11 is ground by the grindstones 48 to a depth near the metal electrodes while the grinding wheel 44*a* is being rotated at a high speed in roughly grinding step S3. Then, while the grinding wheel 44*a* is being rotated at a low speed, the reverse side 11*b* of the workpiece 11 is further ground by the grindstones 48 until part of the layer including the metal electrodes is ground.

In roughly grinding step S3, it is possible to grind the layer including metal electrodes that are harder to grind than silicon, as described above. Moreover, it is possible to prevent the productivity for device chips manufactured by dividing the workpiece 11 from being lowered and also to prevent the footprint of the grinding apparatus 2 from increasing.

In the method of grinding a workpiece according to the present invention, finishing grinding step S5 may be omitted. In other words, in the method of grinding a workpiece according to the present invention, the workpiece 11 may be ground to a predetermined finishing thickness in second grinding step S3.

Further, in the method of grinding a workpiece according to the present invention, spacing step S32 may be omitted. In other words, in the method of grinding a workpiece according to the present invention, the rotational speed of the grinding wheel 44*a* may be changed while the grindstones 48 and the workpiece 11 are being held in abrasive contact with each other.

Moreover, in the method of grinding a workpiece according to the present invention, the workpiece 11 may be ground while the chuck table 18 that holds the workpiece 11 is being lifted. In other words, the grinding apparatus 2 may include a structure capable of moving the grinding wheels 44*a* and 44*b* and the chuck tables 18 relatively to each other, and there is no limitation on such a structure.

The structure, method, etc. according to the above embodiment may be changed or modified appropriately without departing from the scope of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A method of grinding a workpiece to a predetermined finishing thickness, the workpiece having a first layer including a first material and a second layer including a second material that is harder to grind than the first material and stacked on the first layer, the method comprising:

a first grinding step of grinding the first layer of the workpiece held on a chuck table with a plurality of grindstones included in a first grinding wheel and arranged in an annular array while the grinding wheel is being rotated at a first rotational speed; and a second grinding step of grinding the second layer of the workpiece held on the chuck table with the same plurality of grindstones used during the first grinding step while the first grinding wheel is being rotated at a second rotational speed that is lower than the first rotational speed, wherein the first grinding step is carried out after the second grinding step has been carried out, and further wherein the second grinding step is performed until the second layer has been completely removed.

2. The method of grinding a workpiece according to claim 1, further comprising:

between the first grinding step and the second grinding step, a spacing step of spacing the plurality of grindstones and the workpiece from each other.

3. The method of grinding a workpiece according to claim 1, wherein:

the first material is silicon, the second material is silicon oxide.

4. The method of grinding a workpiece according to claim 3, wherein the second grinding step comes to an end upon elapse of a predetermined time after the second layer starts to be ground while the grinding wheel and the chuck table are moved relatively to each other at a predetermined speed to bring the grinding wheel and the chuck table closer to each other.

5. The method of grinding a workpiece according to claim 3, wherein the second grinding step comes to an end when a thickness of the workpiece that is being measured reaches a predetermined thickness.

6. The method of grinding a workpiece according to claim 2, wherein:

the first material is silicon, the second material is silicon oxide.

7. The method of grinding a workpiece according to claim 6, wherein the second grinding step comes to an end upon elapse of a predetermined time after the second layer starts to be ground while the first grinding wheel and the chuck table are moved relatively to each other at a predetermined speed to bring the first grinding wheel and the chuck table closer to each other.

8. The method of grinding a workpiece according to claim 6, wherein the second grinding step comes to an end when a thickness of the workpiece that is being measured reaches a predetermined thickness.

9. The method of grinding a workpiece according to claim 1 further comprising:

a third grinding step of grinding the first layer of the workpiece held on the chuck table with a plurality of grindstones included in a second grinding wheel different from the first grinding wheel.

10. The method of grinding a workpiece according to claim 9, wherein the third grinding step is carried out after the first grinding step.

11. The method of grinding a workpiece according to claim 1, wherein:

the first rotational speed is between 1500 rpm and 6000 rpm; and the second rotational speed is between 700 rpm and 1500 rpm.

12. The method of grinding a workpiece according to claim 1, wherein the chuck table is rotated at a table rotating speed of between 100 rpm and 300 rpm during both the first and second grinding steps.

13. The method of grinding a workpiece according to claim 11, wherein the chuck table is rotated at a table rotating speed of between 100 rpm and 300 rpm during both the first and second grinding steps.

14. The method of grinding a workpiece according to claim 3, wherein:

the first rotational speed is between 1500 rpm and 6000 rpm; and the second rotational speed is between 700 rpm and 1500 rpm.

15. The method of grinding a workpiece according to claim 6, wherein:

the first rotational speed is between 1500 rpm and 6000 rpm; and the second rotational speed is between 700 rpm and 1500 rpm.

16. The method of grinding a workpiece according to claim 1, wherein, during both the first grinding step and the second grinding step, the grinding wheel is moved towards the chuck table at the same predetermined speed.

17. The method of grinding a workpiece according to claim 1, wherein, during both the first grinding step and the second grinding step, the chuck table is rotated at the same predetermined speed.

18. The method of grinding a workpiece according to claim 1, wherein, during both the first grinding step and the second grinding step:

the grinding wheel is moved towards the chuck table at the same predetermined speed; and the chuck table is rotated at the same predetermined rotational speed.

19. A method of grinding a workpiece to a predetermined finishing thickness, the workpiece having a first layer including a first material and a second layer including a second material that is harder to grind than the first material and stacked on the first layer, the method comprising:

a first grinding step of grinding the first layer of the workpiece held on a chuck table with a plurality of grindstones included in a first grinding wheel and arranged in an annular array while the grinding wheel is being rotated at a first rotational speed; and a second grinding step of grinding the second layer of the workpiece held on the chuck table with the same plurality of grindstones used during the first grinding step while the first grinding wheel is being rotated at a second rotational speed that is lower than the first rotational speed, wherein the first grinding step is carried out after the second grinding step has been carried out, and further wherein the second grinding step is performed until the second layer has been completely removed, wherein the first material is silicon and the second material is silicon oxide, and wherein, during both the first grinding step and the second grinding step:

the grinding wheel is moved towards the chuck table at the same predetermined speed; and the chuck table is rotated at the same predetermined rotational speed.

20. The method of grinding a workpiece according to claim 19, wherein:

the first rotational speed is between 1500 rpm and 6000 rpm; and the second rotational speed is between 700 rpm and 1500 rpm.

* * * * *